United States Patent [19]

Sakurai et al.

[11] Patent Number: 5,017,933

[45] Date of Patent: May 21, 1991

[54] VEHICLE WINDOW ANTENNA WITH ANTENNA ELEMENTS ON TWO SURFACES

[75] Inventors: Kaoru Sakurai; Masaru Maeda, both of Kawasaki; Harunori Murakami, Machida; Hiroshi Iijima, Yokohama, all of Japan

[73] Assignee: Nippon Sheet Glass Co., Ltd., Osaka, Japan

[21] Appl. No.: 327,062

[22] Filed: Mar. 22, 1989

[30] Foreign Application Priority Data

Mar. 31, 1988 [JP] Japan ..... 63-43583[U]

[51] Int. Cl.[5] ..... H01Q 1/32

[52] U.S. Cl. ..... 343/704; 343/713

[58] Field of Search ..... 343/704, 711, 713

[56] References Cited

U.S. PATENT DOCUMENTS 4,070,677 1/1978 Meinke et al. ..... 343/704
4,768,037 8/1988 Inaba et al. ..... 343/713

FOREIGN PATENT DOCUMENTS 0037705 3/1984 Japan ..... 343/713
0073403 4/1986 Japan .
0057802 3/1989 Japan .
2193846 2/1988 United Kingdom .

*Primary Examiner*—Rolf Hille
*Assistant Examiner*—Doris J. Johnson
*Attorney, Agent, or Firm*—Pennie & Edmonds

[57] ABSTRACT

The disclosure is directed to a vehicle window equipped with a radio antenna as well as a heating defroster. A laminated window glass is employed advantageously which comprises inner and outer plates of glass facing respectively the interior and exterior of the vehicle. The heating structure is mounted on a first surface of the laminated glass. At least part of the antenna elements is formed on a second surface which is different from the first surface supporting the heater elements. The antenna bearing surface and/or heater bearing surface may be any surface of the laminated glass; the outer surface of the outer glass plate should be excluded from the supporting surface, however, because such surface is exposed to the exterior of the vehicle. Therefore, a relatively large area is always available for the antenna structure irrespective of the size of the window. It becomes more flexible and easier to make the design of antenna having the desired characteristics.

12 Claims, 4 Drawing Sheets

VEHICLE WINDOW ANTENNA WITH ANTENNA ELEMENTS ON TWO SURFACES

BACKGROUND OF THE INVENTION

This invention relates generally to vehicle window antennas and, more particularly to a window glass for use in a vehicle such as automobile having both radio antenna elements and defrosting heating elements mounted thereon.

Window glasses of this kind are known and illustrated in FIGS. 9 and 10. The window glass 30 has a defrosting heating conductor 31 mounted on the inner surface of the glass which is exposed to the interior of a vehicle. In addition, the same inner surface has antenna conductors 33 and 35 attached thereto at the top and bottom margins 32 and 24, respectively. Each antenna conductor is connected to a feed pad 38 from which the current generated in the antenna conductor is supplied to a radio receiver (not shown).

Each element 31, 33, 35 may take the form of either a conductive film of transparent material (see FIG. 9) or a printed conductor made from printing and sintering a conductive paste (FIG. 10).

In either case, antenna conductors 33 and 35 are designed and arranged such that they produce a current as large as possible in response to radio waves over the inended reception band of frequencies. To further improve the antenna gain, antenna conductors 33 and 35 are disposed in capacitive-coupling relationship with the heating conductor 31 which, though its primary function is defrosting, is also able to respond to the radio waves.

Unfortunately, to guarantee an antenna gain which is as high as to meet the receiver system, the margin or area reserved for the antenna element should span a length of approximately 150 to 200 millimeters in the vertical direction of the window glass. Therefore, it was difficult for a relatively small vehicle window (e.g. rear-windshield) used in a small-size automobile to mount an antenna thereon that satisfied the required antenna gain or characteristics. In addition, capacitive coupling occurs only between the opposing edges of the heating conductor array and the antenna conductor array, thus limiting the antenna sensitivity.

It is an object of the invention to provide a vehicle window antenna which overcomes the above-mentioned disadvantages.

SUMMARY OF THE INVENTION

In accordance with the present invention, there is provided a vehicle window antenna comprising a laminated glass for use in a vehicle having inner and outer glasses facing respectively the interior and exterior of the vehicle, and an intermediate layer sandwiched therebetween. Heating conductor means is mounted on a first surface of the laminated glass which is selected from any surface thereof but the outer surface of the outer glass exposed to the exterior of the vehicle.

Antenna conductor means are mounted on a second surface of the laminated glass which is different from the first surface and the outer surface of the outer glass.

With this arrangement, an area that is left over from the heating conductor means and available for antenna conductor means is enlarged because of the use of an laminated window glass. The design of antenna structure is more flexible and easier to make.

Preferably the vehicle window antenna further, comprises additional antenna conductor means which is mounted on the same surface of the laminated glass where the heating conductor means is mounted.

The heating conductor means may be arranged to generate a current in response to radio waves with frequencies desirably received by the antenna system. The antenna conductor means (the first mentioned and/or additional one) is capacitively coupled to the heating conductor means whereby the overall antenna gain is improved.

For example, the heating conductor means comprises a plurality of parallel strip heating elements whereas the first-mentioned antenna conductor means includes at least one strip antenna element which is placed opposite to one of the parallel strip heating elements. The additional antenna conductor means may also comprise at least one strip antenna element which is parallel and adjacent to one of the heating elements on the same surface of the laminated glass.

For preference the antenna conductor means is arranged to have a plurality of different effective antenna lengths whereby the antenna system may receive radio signals over a broad band of frequencies covering, for example, an FM broadcast band.

In accordance with another aspect of the present invention, there is provided a window antenna for use in a vehicle which is equipped with both defrosting heating conductor means and radio antenna conductor means. The heating conductor means is mounted on one surface of the glass whereas at least part of the antenna conductor means is mounted on the other surface of the glass.

Preferably the surface of the vehicle window glass that supports the heating conductor means is exposed to the interior of the vehicle. A protection sheet or film of transparent material is provided which lies over the other surface of the window glass supporting said at least part of the antenna conductor means, the outer surface of the protection sheet being exposed to the exterior of the vehicle.

BRIEF DESCRIPTION OF THE DRAWINGS

In order that the invention may be better understood, preferred embodiments thereof will now be described by way of example only and with reference to the accompanying drawings in which.

DETAILED DESCRIPTION OF PREFERRED EMBODIMENTS

Figure 1:
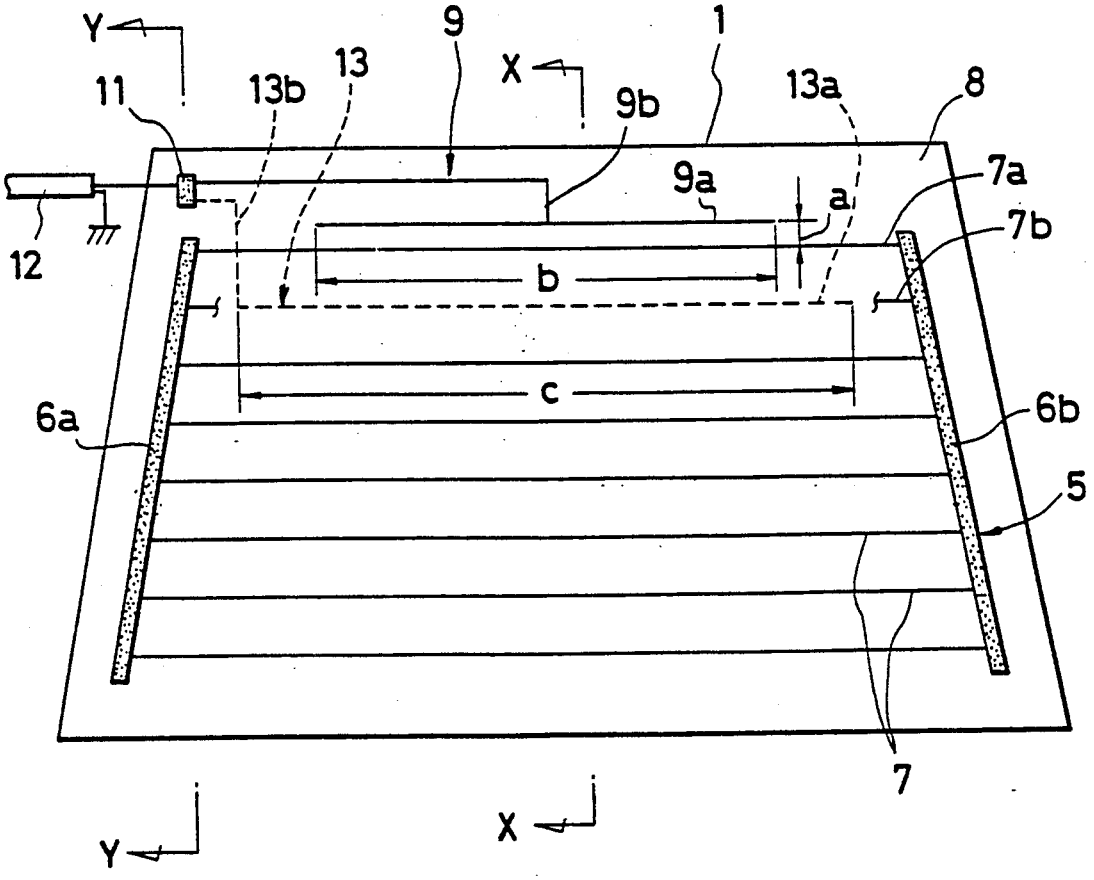
FIG. 1 is a front view of a rear-windshield glass incorporating the features of the invention.
Figure 2:
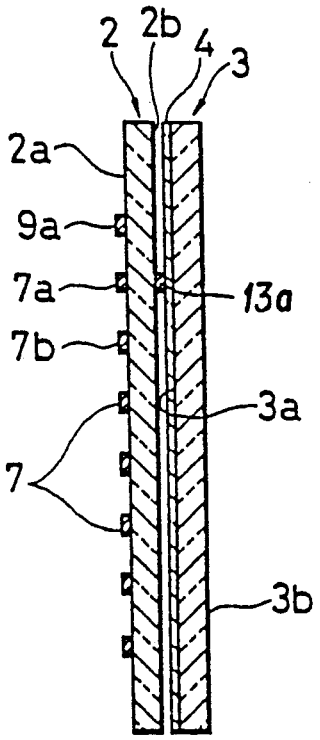
FIG. 2 is a cross sectional view of the rear-windshield glass taken along a line X in FIG. 1.
Figure 3:
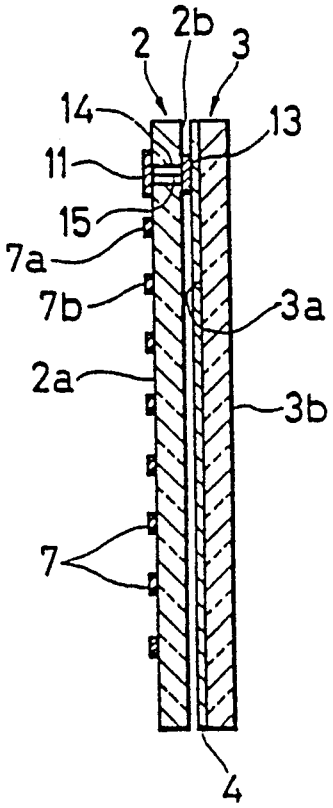
FIG. 3 is a cross sectional view of the rear-windshield glass taken along a line Y in FIG. 1.

Referring now to FIGS. 1 to 3, there is shown a rear-windshield glass 1 for use in an automobile constructed according to the teachings of the present invention. The rear-windshield glass 1 is formed by a laminated glass comprising a pair of inner and outer glass plates 2 and 3 facing respectively the interior and exterior of an automobile when mounted therein, and an intermediate layer of resin material sandwiched between the glass plates 2 and 3. Thus, the laminated glass 1 has four surfaces, namely the inner surface 2*a* of the inner glass 1 exposed to the interior of the vehicle, the outer surface 2*b* of the inner glass 2 and inner surface 3*a* of the outer glass 3 on each side of the intermediate layer 4 and the outer surface 3*b* of the outer glass 3 exposed to the exterior of the automobile.

A defrosting heating conductor 5 is mounted on the inner surface 1*a* of the inner glass 2 so as to extend over the central portion thereof. More specifically the heating conductor 5 comprises a pair of spaced bus bars 6*a* and 6*b* on the left and right sides of the surface 2*a* and a plurality of parallel strip heating elements 7 extending between the bars 6*a* and 6*b*.

Also mounted on the same surface 2*a* is an antenna conductor 9 which extends over the top margin 8 thereof. Note that such a margin has a small area; if this area only were available for antenna elements, it would be inflexible or infeasible to design and implement a satisfactory antenna structure.

The illustrated antenna conductor 9 comprises a horizontal strip antenna element 9*a* parallel and adjacent to the uppermost strip heating element 7*a* of the heater 5 and a lead strip element 9*b* branching upwards from the center of the horizontal antenna element 9*a*, turning left and extending horizontally to a feed pad 11 formed on the left-hand corner of the glass surface 2*a*. The length b of the horizontal antenna element 9*a* is approximately 800 millimeters so as to be tuned to a band of broadcasting FM frequencies (76 to 90 MHz). The space a between the antenna element 9*a* and the heating element 7*a* is about 5 millimeters to establish a capacitive coupling therebetween whereby the current produced in the heating conductor 5 in response to radio waves is virtually connected to an antenna conductor 9 thereby to improve its sensitivity.

The feed pad or antenna terminal 11 is connected to a receiver unit (not shown) by means of an antenna feeder 12.

The antenna conductor 9, when used alone, can only provide a relatively low gain and merely cover a narrow band of frequencies. To overcome these problems, there is provided an additional antenna conductor 13 which is mounted on the back of the glass plate 2, that is, on the outer surface 2*b* of the inner plate 2. The antenna conductor 13 comprises a horizontal strip antenna element 13*a* having a length c of approximately 900 millimeters and placed directly opposite to the second uppermost heating element 7*b*. A lead strip element 13*b* extends upwards from the left-hand end of the horizontal antenna element 13*a*, then bends left to reach the back of the feed pad 11.

As is best seen from FIG. 3, a through hole 14 is formed in the inner glass 2 at the position corresponding to the feed pad 11 for connection between the antenna conductor 13 and the pad 11. In the present example, a copper foil 15, typically 10 millimeters wide is fit in the hole 14 and allows conduction of the received current from the antenna conductor 13 to the pad 11.

It will be understood that the laminated window glass 1, while typically small in size, can provide a sufficient area for the antenna including both of the antenna conductors 9 and 13 by making the most of the surfaces of the laminated glass. Therefore, the design of window antenna having the desired characteristics such as effective antenna lengths will be more flexible and easier to make. In addition, the antenna conductors 9 and 13 can be arranged such that both of the antenna conductors are capacitively coupled with a heater conductor 5 whereby the current produced in the heater conductor in response to radio waves will induce a corresponding current in the antenna conductors to further improve the overall antenna gain.

Figure 4:
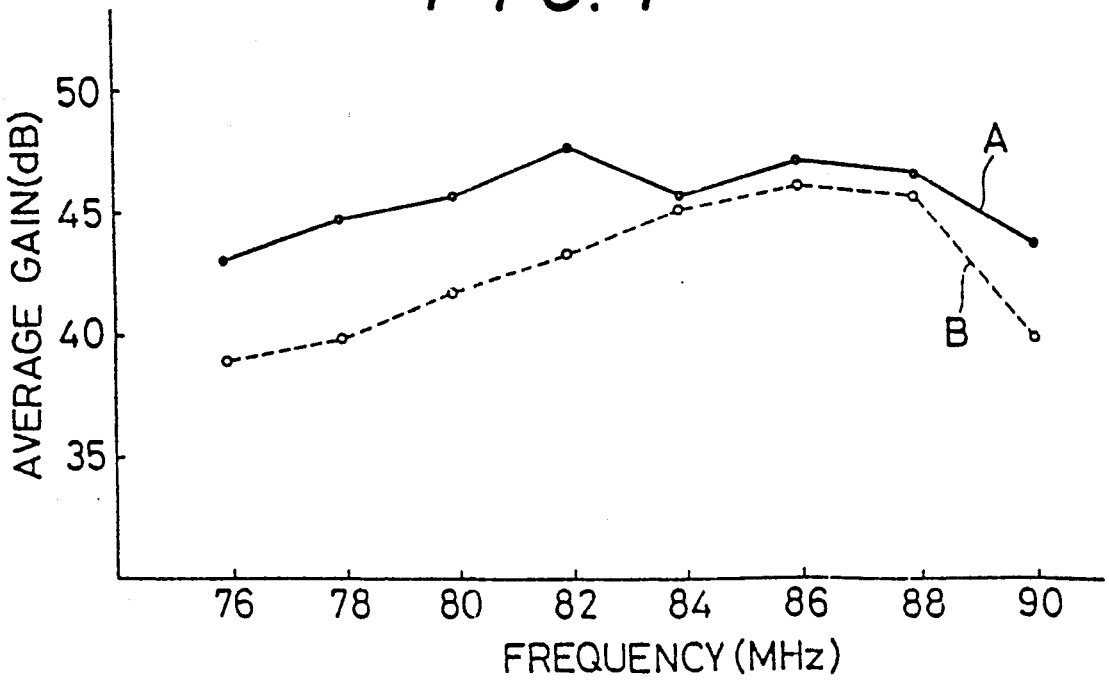
FIG. 4 is a graph of frequency versus antenna gain and showing two different antenna frequency/gain characteristics, one measured for the arrangement of FIG. 1 and the other measured without the antenna conductor 13.

FIG. 4 shows a frequency versus antenna gain graph. Curve A was measured for the antenna arrangement of FIG. 1 using both of the antenna conductors 9 and 13. Curve B was obtained with the antenna conductor 9 only. The effectiveness of the additional antenna conductor 13 was substantial as depicted in FIG. 4. The antenna gain over the entire range of frequencies 76 to 90 MHz was improved. In particular, great improvement was observed near the ends of the band.

Figure 5:
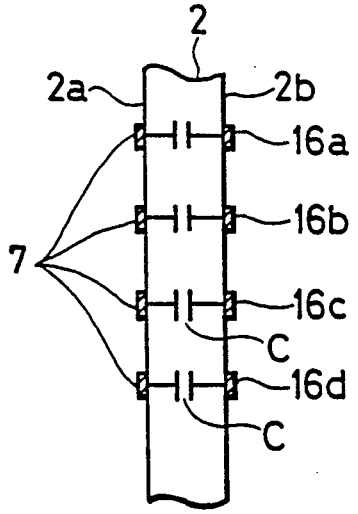
FIGS. 5 and 6 illustrate how heating elements 7 are capacitively coupled to antenna elements 16, 17 by means of a glass plate 2.

Whereas the arrangement of FIG. 1 employs a single horizontal antenna element 13*a* on the back 2*b* of the glass 2, a plurality of parallel strip elements can be substituted as illustrated in FIG. 5 in which the parallel strip conductors 16*a* to 16*d* are advantageously arranged on the back 2*b* of the glass 2 such that the respective conductors 16*a* to 16*d*, which may have effective antenna lengths different from one another, are placed directly opposite plural heater strip elements disposed over the inner surface 2*a* of the glass 2. In this arrangement, capacitive coupling (designated c in FIG. 5) between the antenna elements 16*a* to 16*d* and the heating elements 7 is maximized, and at the same time each coupling pair is placed in the same horizontal plane so that the addition of the plural elements 16*a* to 16*d* will not impair visibility through the window. It is possible, however, that the antenna element 16*a* to 16*d* may desirably be offset relative to the heater elements 7.

Figure 6:
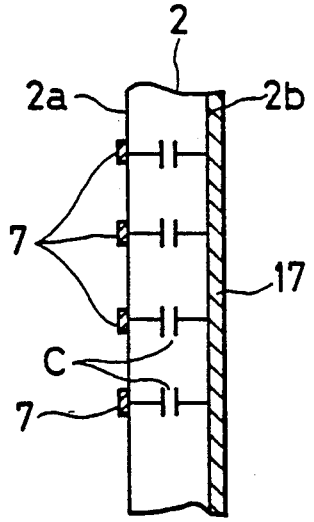

Instead of the printed antenna elements, a transparent film 17 of conductive material can be used as shown in FIG. 6.

A modification of the vehicle rear-windshield glass will now be described with reference to FIGS. 7 and 8.

In this embodiment, the inner surface 2*a* of the inner glass plate 2 of the laminated glass 1 is furnished with a heating conductor 5 in the form of a transparent conductive film 18 extending over the central portion thereof. The same inner surface 2*a* is also supplied with part 20*a* of a first antenna conductor 20 on the top margin 8 thereof and part 22*b* of a second antenna conductor 22 on the bottom margin. The remaining portions 20*b*, 22*b* of the first and second antenna conductors 20 and 22 are formed on the back 2*b* of the inner glass 2. Each antenna conductor 20, 22 shown in FIGS. 7 and 8 takes the form of a transparent film of conductive material. The corresponding antenna films on opposite faces 2*a* and 2*b* of the inner glass 2 are electrically connected to each other.

Figure 7:
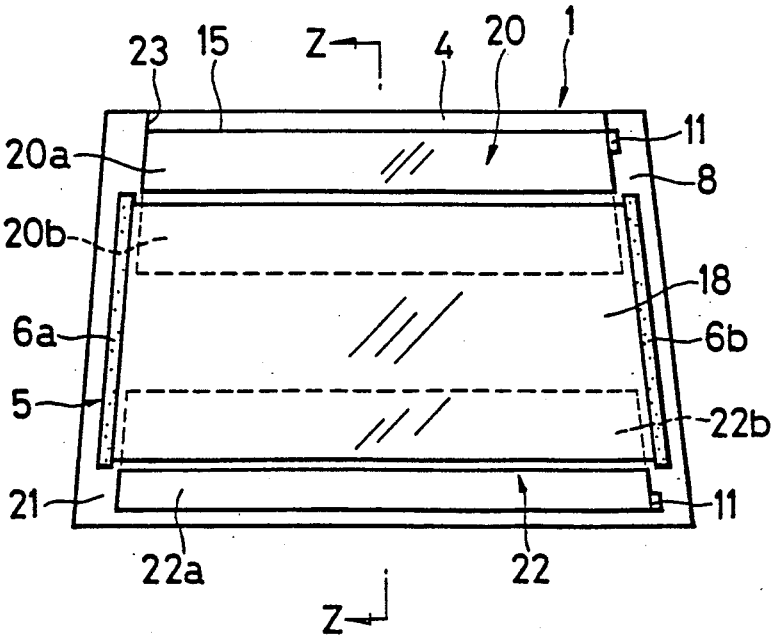
FIG. 7 is a front view of a modified rear-windshield glass.
Figure 8:
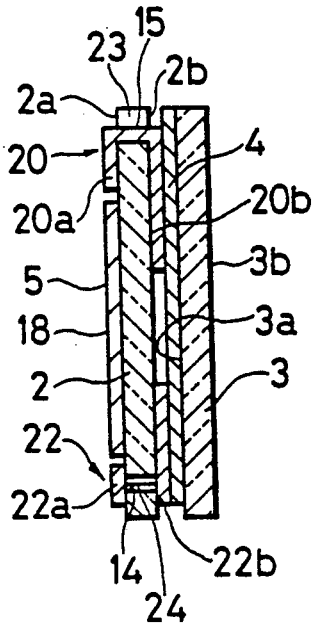
FIG. 8 is a cross sectional view of the rear-windshield glass taken along a line Z in FIG. 7.
Figure 9:
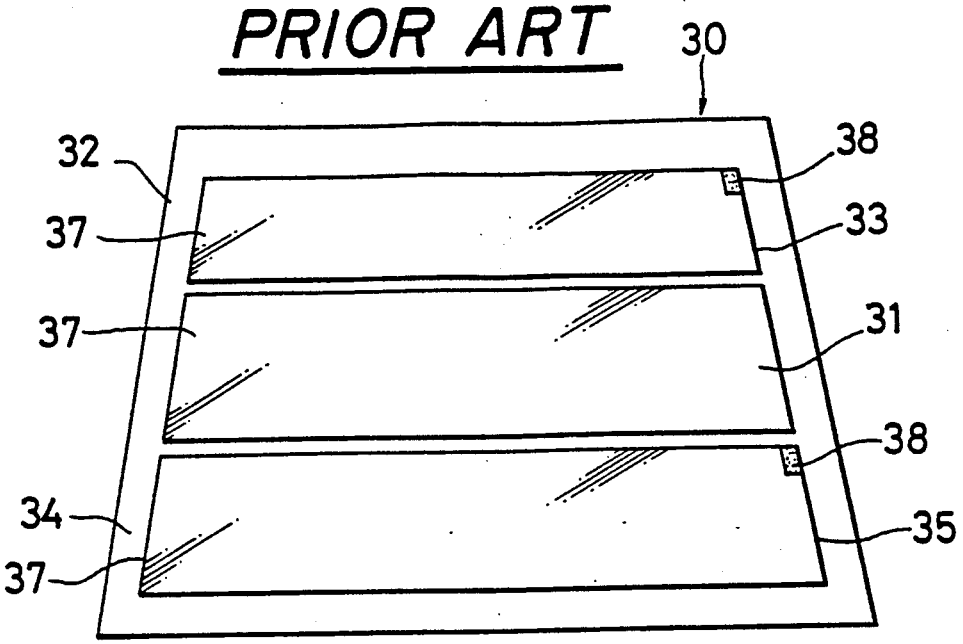
FIG. 9 PRIOR ART
FIG. 9 is a front view of prior art rear-windshield glass with an antenna and a defrosting heater in the form of printed strip elements.
Figure 10:
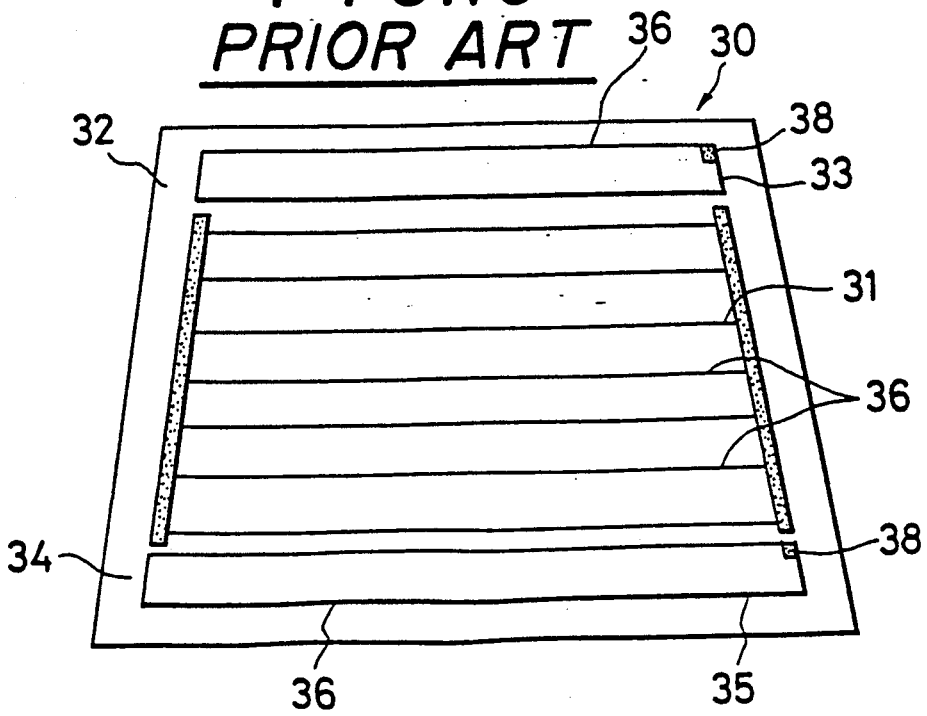
FIG. 10 PRIOR ART
FIG. 10 is a front view of another prior art rear-windshield glass with an antenna and a defroster in the form of transparent films.

As shown in FIGS. 7 and 8, a cut 23 is formed along the upper edge of the inner glass 2. Attached to the cut 23 is a copper foil 15 which connects the portion 20*a* of the first antenna structure 20 to the rest 20*b*. A through hole 14 similar to the one shown in FIG. 3 is formed in the lower portion of the inner glass 2. A copper wire 24 extends through the hole 14 thereby to provide a connection between the parts 22*a* and 22*b* of the second antenna structure 22.

In this manner, both the inner and outer surfaces 2*a* and 2*b* of the glass plate 2 are utilized for an antenna structure. Therefore, an antenna of broad band type which generally requires a large area can be formed on a vehicle window even if only a small space of the glass surface remains after having mounted a defrosting heater on the same surface, as experienced in a small-size automobile.

The connection between the parts of the antenna structure on each side 2*a*, 2*b* of the inner glass could be made indirectly without the use of direct connecting means 15 and 24.

This concludes the description of preferred embodiments. However, many modifications and variations will be apparent to those of ordinary skill in the art. For example, the heating conductor and/or antenna conductor may be formed on any other surface of the laminated glass: however, the outer surface 3*b* of the outer glass plate 3 should be excluded because such surface is exposed to the exterior of an automobile. The antenna and heater elements may be mounted on other windows of the vehicle such as front windshield and rear quarter window. The disclosure on the following claims are therefore intended to cover all such modifications and variations.

What is claimed is:

1. A vehicle window antenna comprising:

a laminated glass for use in a vehicle having inner and outer glasses facing respectively the interior and exterior of the vehicle, and an intermediate layer sandwiched therebetween;

heating conductor means mounted on a first surface of said laminated glass which is selected from all surfaces thereof but the outer surface of said outer glass exposed to the exterior of the vehicle;

first antenna conductor means mounted on a second surface of said laminated glass which is different from said first surface and said outer surface of said outer glass; and second antenna conductor means mounted on the same surface of said laminated glass as said heating conductor means.

2. The vehicle window antenna as claimed in claim 1 wherein said heating conductor means is arranged to generate a current in response to radio waves having frequencies to be received by said motor vehicle antenna, said first antenna conductor means being capacitively coupled to said heating conductor means whereby the antenna gain is improved.

3. The vehicle window antenna as claimed in claim 2 wherein said heating conductor means includes a plurality of parallel strip heating elements and said first antenna conductor means includes at least one strip antenna element which is placed opposite to one of the parallel strip heating elements of said heating conductor means.

4. The vehicle window antenna as claimed in claim 2 wherein said heating conductor means includes a plurality of parallel strip heating elements and said first antenna conductor means take the form of a transparent film or films which are placed opposite to at least one of the parallel strip heating elements of said heating conductor means.

5. The vehicle window antenna as claimed in claim 2 wherein said heating conductor means and said first and second antenna conductor means each take the form of a transparent film or films.

6. The vehicle window antenna as claimed in claim 2 wherein said first and second antenna conductor means are arranged to receive radio signals over a broad band of frequencies.

7. The vehicle window antenna as claimed in claim 6 wherein said broad band covers FM broadcast frequencies.

8. The vehicle window antenna as claimed in claim 2 wherein said heating conductor means is arranged to generate a current in response to radio waves having frequencies to be received by said antenna, said second antenna conductor means being capacitively coupled to said heating conductor means whereby the antenna gain is improved 9. The vehicle window antenna as claimed in claim 8 wherein said heating conductor means includes a plurality of parallel strip heating elements and said second antenna conductor means includes at least one strip antenna element which is placed parallel and adjacent to one of the strip heating elements of said heating conductor means.

10. The vehicle window antenna as claimed in claim 2 wherein said first antenna conductor means and said second antenna conductor means are arranged to receive radio signals over a broad band of frequencies.

11. The vehicle window antenna as claimed in claim 10 wherein said broad band covers FM broadcast frequencies.

12. The vehicle window antenna as claimed in claim 2 wherein said first and second antenna conductor means have different effective antenna lengths.

* * * * *